US006781539B2

(12) United States Patent
Matsui

(10) Patent No.: US 6,781,539 B2
(45) Date of Patent: Aug. 24, 2004

(54) REMOTE CONTROL TRANSMITTER

(75) Inventor: Noriaki Matsui, Fukui (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 632 days.

(21) Appl. No.: 09/852,108

(22) Filed: May 9, 2001

(65) Prior Publication Data

US 2002/0005797 A1 Jan. 17, 2002

(30) Foreign Application Priority Data

May 10, 2000 (JP) ..... 2000-137336

(51) Int. Cl.[7] ..... G08C 19/00
(52) U.S. Cl. ..... 341/176; 345/169; 340/825.72
(58) Field of Search ..... 341/176; 345/169, 345/462.45, 168, 170; 340/825.72, 825.69; 348/734; 235/462.46, 472.02; 398/106; 362/552, 555, 84, 800

(56) References Cited

U.S. PATENT DOCUMENTS 4,712,105 A * 12/1987 Kohler ..... 340/825.69

6,590,505 B1 * 7/2003 Matsui et al. ..... 340/825.72

* cited by examiner

*Primary Examiner*—Michael Horabik
*Assistant Examiner*—Hung Dang
(74) *Attorney, Agent, or Firm*—RatnerPrestia

(57) ABSTRACT

A remote control transmitter for operating an electronic appliance with an infrared ray, which is easy-to-operate and inexpensive. The remote control transmitter does not change the illumination of an illuminating device even when an operation key is manipulated. The remote control transmitter has a voltage control circuit including a diode having substantially the same power consumption as an infrared ray output means, and a control transistor connected parallel to the diode for turning on and off according to the electric signal from a microcomputer. Since a current flowing in the diode is controlled by the control transistor, a constant voltage is always applied to the driving circuit for lighting up the illuminating device regardless of an manipulation of the operation key.

2 Claims, 4 Drawing Sheets

REMOTE CONTROL TRANSMITTER

FIELD OF THE INVENTION

The present invention relates a remote control transmitter for remote-controlling various electronic appliances with infrared rays.

BACKGROUND OF THE INVENTION

Recently, as various electronic appliances are developed and diversified in functions, remote control transmitters used for operations with them are provided with an illuminating function so as to be manipulated in a dark place.

A conventional remote control transmitter will be explained with referring to FIG. 4.

FIG. 4 is a circuit diagram of the conventional remote control transmitter. An operation key group 1 comprising translucent operation buttons and push switches. An internal memory (not shown) of a microcomputer 2 connected to the operation key group 1 stores several kinds of remote control transmission data for remote-controlling various electronic appliances such as a television and a video deck. Infrared ray output means 3 connected to the microcomputer 2 is serially connected to a driving transistor 4, a current limiting resistance 5, and an infrared ray light emitting diode (LED) 6. And further, a battery 7 is connected. A driving circuit 9 applies a specified voltage to an illuminating device 8 such as a light emitting diode or an EL disposed at the back of the operation key group 1, and makes the device illuminates it. A light switch 10 is disposed between the driving circuit 9 and battery 7 for turning on and off the driving circuit 9. They are covered with a case (not shown).

When any key in the operation key group 1 is manipulated, the remote control transmission data corresponding to the manipulated key stored in the internal memory is issued from the microcomputer 2 as an electric signal having a pulse waveform. The electric signal is amplified by the driving transistor 4 in the infrared ray output means 3. The current corresponding to the electric signal flows through the resistance 5, and thus, the LED 6 flickers and transmits the infrared ray signal to operate the electronic appliance.

When the light switch 10 is manipulated, the driving circuit 9 applies a specified voltage to the illuminating emitting device 8, and the device 8 illuminate the operation key group 1 from the back. That makes the operation key group 1 be manipulated easily in a dark place.

In the conventional remote control transmitter, when the operation key group 1 is manipulated while the illuminating device 8 is lit up, a current of about hundreds milliamperes flows in the LED 6, and thus, the voltage in the battery 7 is lowered. As a result, the applied voltage to the driving circuit 9 drops, and the luminance of the illuminating device 8 declines. Therefore, the illumination flickers, and the flickering makes to see the operation key group 1 hard.

SUMMARY OF THE INVENTION

An easy-to-operate and inexpensive remote control transmitter in provided in which the luminance of the illuminating device even when an operation key is manipulated without requiring drastic change from the prior art.

The remote control transmitter comprises the following parts:

(a) An operation key;

(b) A microcomputer including an internal memory for storing remote control transmission data, for issuing the data as an electric signal with the manipulation of the operation key;

(c) Infrared ray output means for issuing an infrared ray signal according to the electric signal issued by the microcomputer;

(d) An illuminating device for illuminating the operation key;

(e) A driving circuit for applying a specified voltage to the illuminating device for lighting up the illuminating device;

(f) A light switch for turning on and off the driving circuit; and (g) A voltage control circuit including a diode having substantially the same power consumption as the infrared ray output means and being connected to the driving circuit, and a switching element connected parallel to the diode which is turned on and off by the electric signal issued by the microcomputer.

DESCRIPTION OF THE PREFERRED EMBODIMENT

Figure 2:
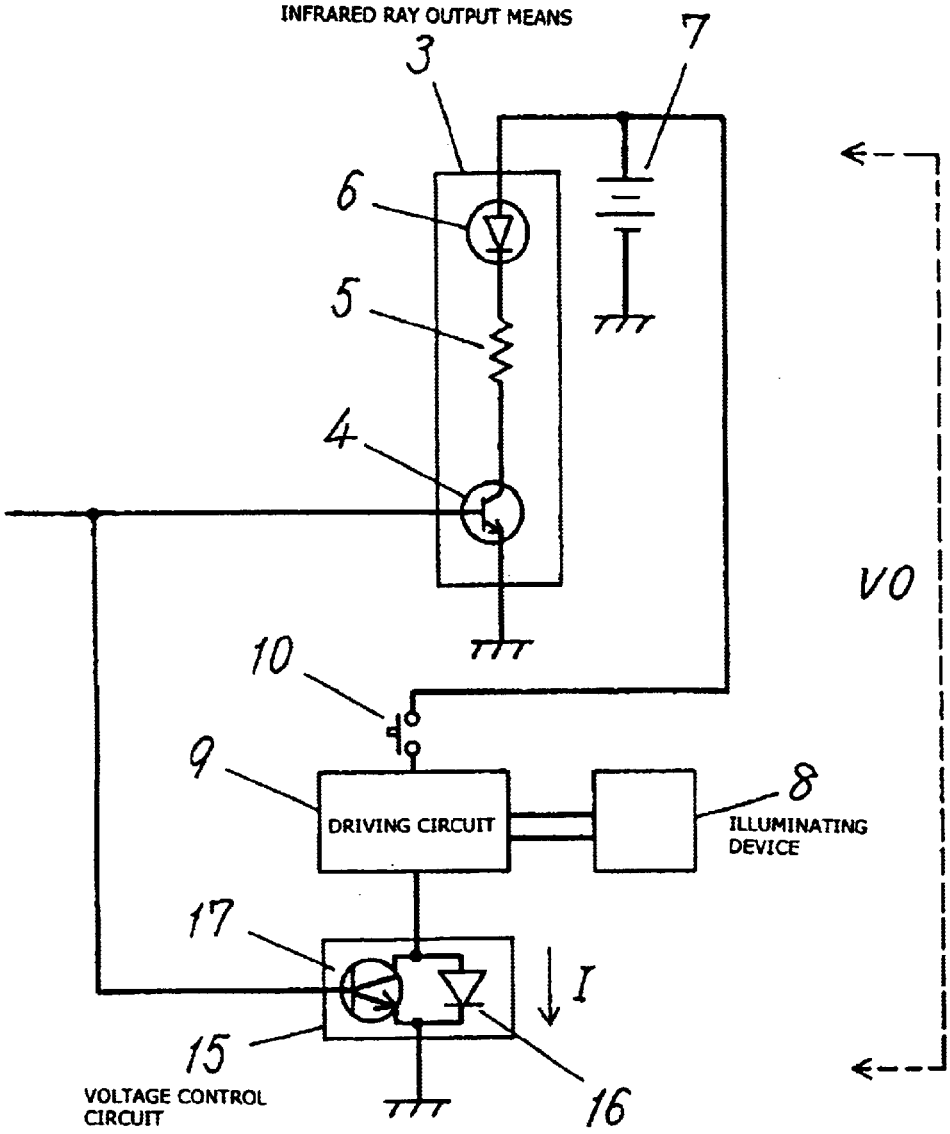
FIG. 2 is a partial circuit diagram of the remote control transmitter.
Figure 3:
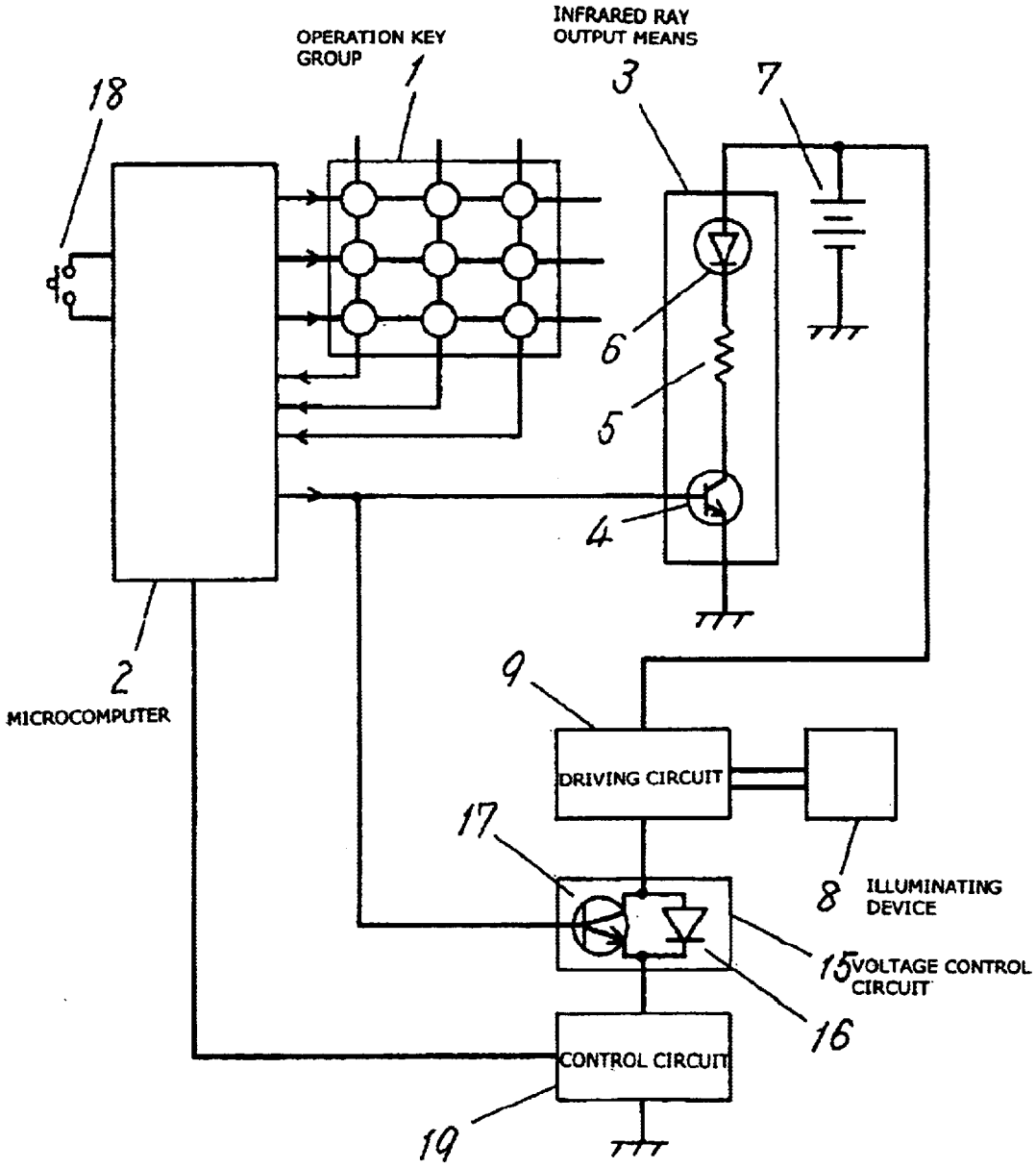
FIG. 3 is a circuit diagram of another remote control transmitter according to the embodiment.
Figure 4:
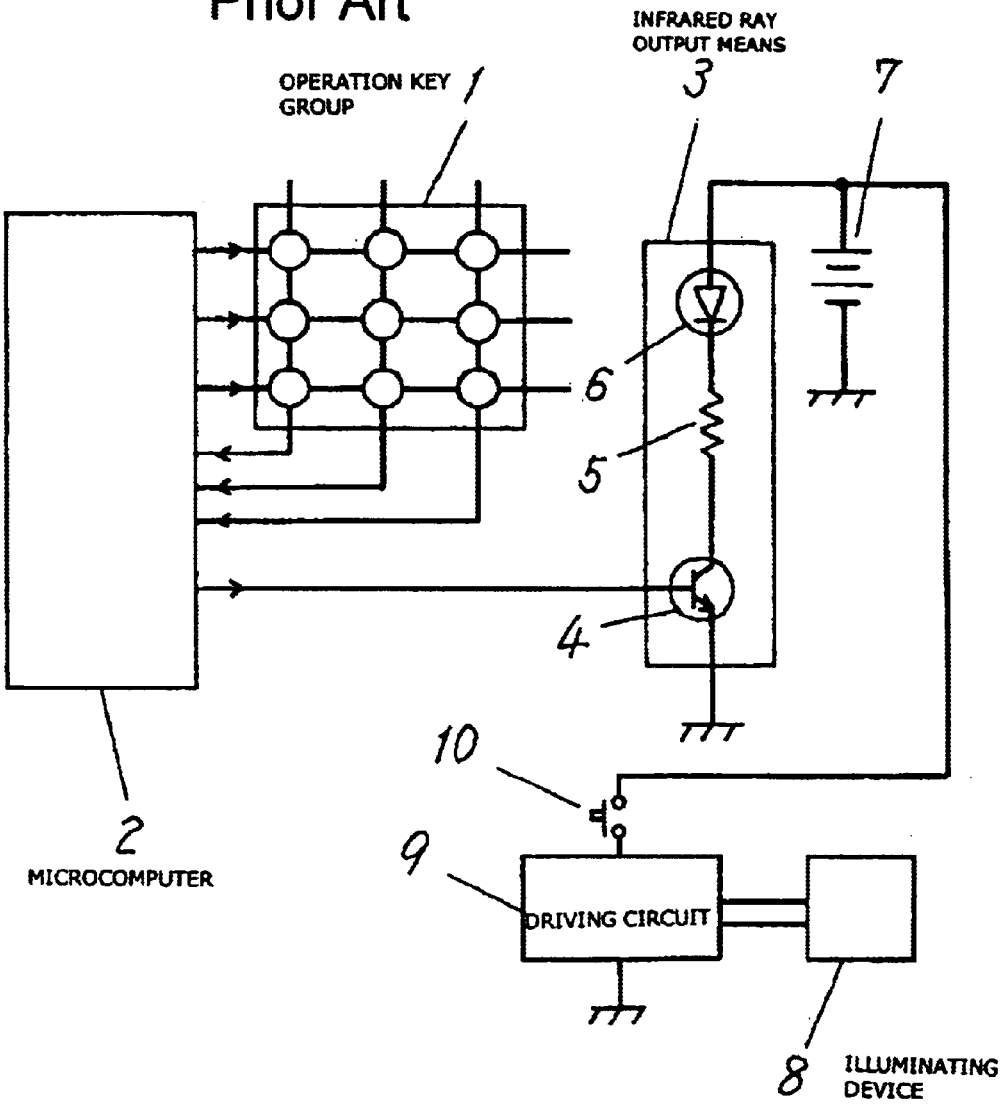
Fig. 4 Prior Art
FIG. 4 is a circuit diagram of a conventional remote control transmitter.

A remote control transmitter according to an exemplary embodiment of present the invention will be described below while referring to FIG. 1 to FIG. 3. The same parts as explained in the prior art will be denoted by the same reference numerals, and the detailed explanation will be omitted.

Figure 1:
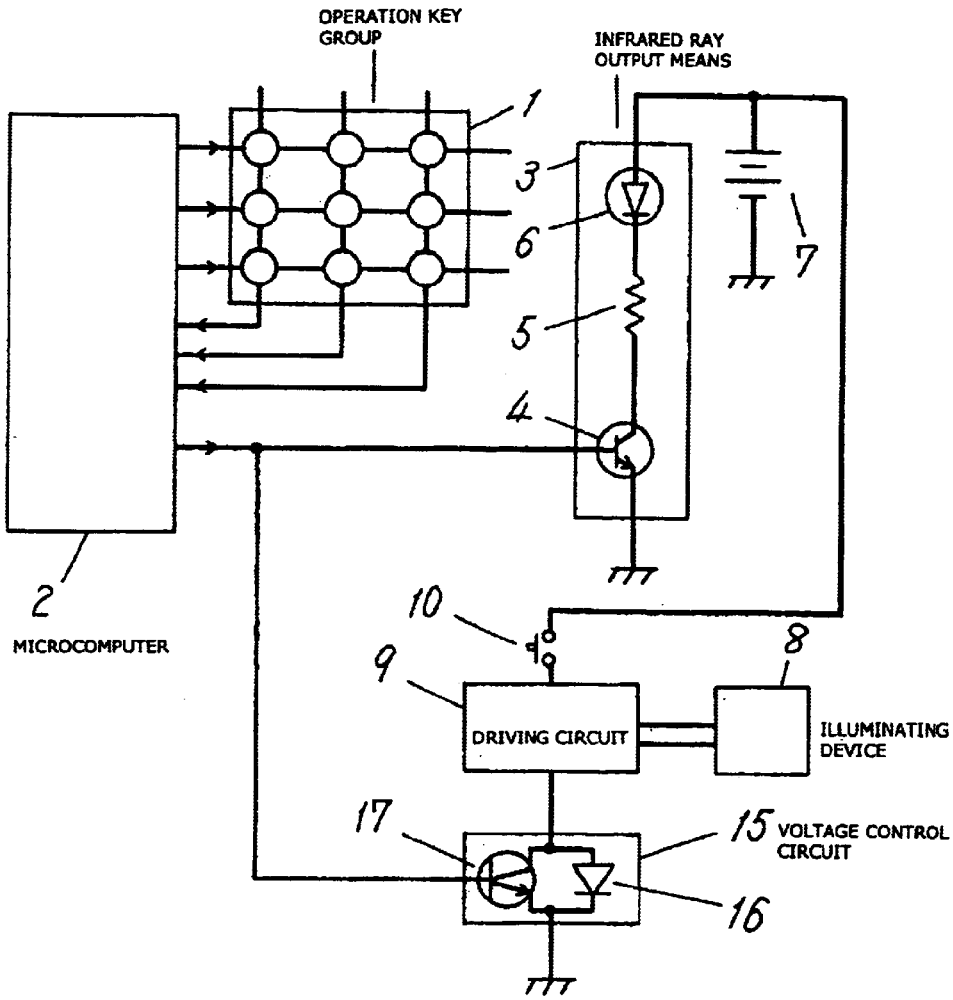
FIG. 1 is a circuit diagram of a remote control transmitter according to an exemplary embodiment of the present invention.

FIG. 1 is a circuit diagram of a remote control transmitter according to an exemplary embodiment of the present invention. A microcomputer 2 is connected to an operation key group 1 comprising translucent operation buttons and push switches. An internal memory (not shown) of the microcomputer 2 stores several kinds of remote control transmission data for remote-controlling various electronic appliances such as a television and a video deck. Infrared ray output means 3 connected to the microcomputer 2 is serially connected to a driving transistor 4, a current limiting resistance 5, and a light emitting diode (LED) 6. And further, a battery 7 is connected to the means 3. A driving circuit 9 applies a specified voltage to an illuminating device 8 such as an LED or an electro luminescence disposed at the back of the operation key group 1, and illuminates it. Between the driving circuit 9 and battery 7, a light switch 10 is disposed for opening and closing the driving circuit 9.

A voltage control circuit 15 includes a diode 16 having substantially the same power consumption as the infrared ray output means 3 and being connected to the driving circuit 9, and a control transistor 17, as a switching element, connected parallel to the diode 16 for being turned on and off by the electric signal of the microcomputer 2. They are covered by a case (not shown).

When any key in the operation key group 1 is manipulated, the remote control transmission data corresponding to the manipulated key stored in the internal memory is issued from the microcomputer 2 as an electric signal having a pulse waveform. The electric signal is amplified by the driving transistor 4 in the infrared ray output means 3, and a current corresponding to the electric signal flows through the resistance 5. As a result, the LED 6 flickers and transmits an infrared ray signal to operate an electronic appliance.

When the light switch 10 is manipulated, the driving circuit 9 applies a specified voltage to the illuminating device 8, and the device 8 illuminates the operation key group 1 from the back. At this time, if the operation key group 1 is not manipulated, the remote control transmission data from the microcomputer 2 is not issued, and hence, the control transistor 17 is turned off. Therefore, as shown in the partial circuit diagram in FIG. 2, a current I flows into the diode 16 connected to the driving circuit 9. And the diode 16 consumes an electric power and hence declines the voltage V0 of the battery 7. The lowered voltage V1 is applied to the driving circuit 9, and the illuminating device 8 lights up.

When the operation key group 1 is manipulated while the illuminating device 8 is lit, the remote control transmission data is issued from the microcomputer 2 as an electric signal, and the control transistor 17 is turned on by the electric signal from the microcomputer 2. At this time, a current flows in the control transistor 17, but no current flows in the diode 16, so that the electric power may not be consumed. Therefore, voltage V2 lowered from the voltage V0 of the battery 7 by a power consumed in the infrared ray output means 3 is applied to the driving circuit 9, and the illuminating device 8 is lit up.

Since the power consumption of the diode 16 and that of infrared ray output means 3 are substantially the same, the voltage V1 applied to the driving circuit 9 is equal to the voltage V2. Therefore, in the driving circuit 9 for lighting up the illuminating device 8, the common voltage is applied regardless the operation key group 1 is manipulated or not. And thus, the remote control transmitter where the illumination of the illuminating device 8 does not change even when the operation key group 1 is manipulated while the illuminating device 8 is being lit.

Further, just two additional electronic components, the diode 16 and control transistor 17 as the voltage control circuit 15 realizes the remote control transmitter which is relatively inexpensive without drastically changing the conventional structure.

In the above explanation, the voltage control circuit 15 has the single diode 16, but it may have plural diodes connected in series as the diode 16 depending on the power consumption of the infrared ray output means 3.

As explained above, the light switch 10 directly turns on and off the driving circuit 9. As shown in the circuit diagram in FIG. 3, a light switch 18 may be connected to the microcomputer 2, and a control circuit 19 for controlling the driving circuit 9 may convert the electric signal issued from the microcomputer 2. According to a manipulation of the lighting switch 18, the microcomputer 2 issues a predetermined electric signal for a predetermined time, and controls the control circuit 19 to light up the illuminating device 8 for a predetermined time. In this configuration, it is not necessary to turned on an off the light switch 18 every time, and thus, a much easier-to-use remote control transmitter is obtained.

The control transistor 17 functions as the switching element in the voltage control circuit 15, but instead, an FET or an analog switch may be employed for controlling the current flowing in the diode 16.

What is claimed is:

1. A remote control transmitter comprising:

an operation key, a microcomputer including an internal memory for storing remote control transmission data, said microcomputer issuing the remote control transmission data as an electric signal by a manipulation of said operation key, infrared ray output means for issuing an infrared ray signal according to the electric signal issued by said microcomputer, an illuminating device for illuminating said operation key, a driving circuit for applying a specified voltage to said illuminating device for lighting up said illuminating device, a light switch for turning on and off said driving circuit, and a voltage control circuit including:

a diode having substantially the same power consumption as said infrared ray output means, said diode being coupled to said driving circuit, and a switching element coupled parallel to said diode, said switching element being turned on and off according to the electric signal issued by said microcomputer.

2. The remote control transmitter according to claim 1, wherein said light switch is coupled to said microcomputer, and said microcomputer lights up said illuminating device for a predetermined time by controlling said driving circuit based on a manipulation of said light switch.

* * * * *